US008389128B2

(12) United States Patent
Takagi et al.

(10) Patent No.: US 8,389,128 B2
(45) Date of Patent: Mar. 5, 2013

(54) HIGH TENSILE-STRENGTH GALVANIZED STEEL SHEET AND PROCESS FOR MANUFACTURING HIGH TENSILE-STRENGTH GALVANIZED STEEL SHEET

(75) Inventors: Shusaku Takagi, Chiba (JP); Hidetaka Kawabe, Chiba (JP); Kohei Hasegawa, Hiroshima (JP); Toshihiko Ooi, Chiba (JP); Yasuaki Okita, Chiba (JP); Michitaka Sakurai, Hiroshima (JP)

(73) Assignee: JFE Steel Corporation (JP)

( * ) Notice: Subject to any disclaimer, the term of this patent is extended or adjusted under 35 U.S.C. 154(b) by 709 days.

(21) Appl. No.: 12/595,555

(22) PCT Filed: Apr. 7, 2008

(86) PCT No.: PCT/JP2008/057224

§ 371 (c)(1), (2), (4) Date: Nov. 18, 2009

(87) PCT Pub. No.: WO2008/133062

PCT Pub. Date: Nov. 6, 2008

(65) Prior Publication Data

US 2010/0132849 A1 Jun. 3, 2010

(30) Foreign Application Priority Data

Apr. 13, 2007 (JP) ..... 2007-106250
Feb. 26, 2008 (JP) ..... 2008-044833

(51) Int. Cl.
*B32B 15/01* (2006.01)
*C21D 8/02* (2006.01)
*C22C 38/22* (2006.01)

(52) U.S. Cl. ..... 428/659; 148/603; 148/533; 148/334

(58) Field of Classification Search ..... 148/533, 148/334, 603; 428/659
See application file for complete search history.

(56) References Cited

U.S. PATENT DOCUMENTS

| | | | |
|---|---|---|---|
| 6,869,691 | B2 | 3/2005 | Nagataki et al. |
| 2003/0106620 | A1 | 6/2003 | Nagataki et al. |

FOREIGN PATENT DOCUMENTS

| | | | |
|---|---|---|---|
| EP | 1 367 143 | A1 | 12/2003 |
| JP | 6-073497 | A | 3/1994 |
| JP | 11-236621 | A | 8/1999 |
| JP | 2001-011538 | A | 1/2001 |
| JP | 2001-192768 | A | 7/2001 |
| JP | 2001-207235 | A | 7/2001 |
| JP | 3263143 | B2 | 3/2002 |
| JP | 2002-235145 | A | 8/2002 |
| JP | 2002-256386 | A | 9/2002 |
| JP | 2002-317245 | A | 10/2002 |
| JP | 2003-221623 | A | 8/2003 |
| JP | 2004-211140 | A | 7/2004 |
| JP | 2004-232011 | A | 8/2004 |
| JP | 2004-285435 | A | 10/2004 |
| JP | 2004-292881 | A | 10/2004 |
| JP | 3596316 | B2 | 12/2004 |
| JP | 2005-105367 | A | 4/2005 |
| JP | 2006-063360 | A | 3/2006 |
| WO | 02/068703 | | 9/2002 |

OTHER PUBLICATIONS

Machine-English translation of Japanese patent No. 2004-323958, Osawa Kazunori et al., Nov. 18, 2004.*
Machine-English translation of Japanese patent No. 2006-052455, Nakagawa Hiroyuki et al., Feb. 23, 2006.*

* cited by examiner

*Primary Examiner* — Deborah Yee
(74) *Attorney, Agent, or Firm* — DLA Piper LLP (US)

(57) ABSTRACT

A high tensile-strength galvanized steel sheet includes C: at least 0.05% but less than 0.12%, Si: at least 0.01% but less than 0.35%, Mn: 2.0% to 3.5%, P: 0.001% to 0.020%, S: 0.0001% to 0.0030%, Al: 0.005% to 0.1%, N: 0.0001% to 0.0060%, Cr: more than 0.5% but not more than 2.0%, Mo: 0.01% to 0.50%, Ti: 0.010% to 0.080%, Nb: 0.010% to 0.080%, and B: 0.0001% to 0.0030%, the remainder being Fe and unavoidable impurities, wherein the high tensile-strength galvanized steel sheet has a microstructure that contains 20% to 70% by volume ferrite having an average grain size of 5 μm or less. The high tensile-strength galvanized steel sheet has a tensile strength of at least 980 MPa, and excellent formability and weldability.

7 Claims, No Drawings

HIGH TENSILE-STRENGTH GALVANIZED STEEL SHEET AND PROCESS FOR MANUFACTURING HIGH TENSILE-STRENGTH GALVANIZED STEEL SHEET

RELATED APPLICATIONS

This is a §371 of International Application No. PCT/JP2008/057224, with an international filing date of Apr. 7, 2008 (WO 2008/133062 A1, published Nov. 6, 2008), which is based on Japanese Patent Application Nos. 2007-106250, filed Apr. 13, 2007, and 2008-044833, filed Feb. 26, 2008, the subject matter of which is incorporated by reference.

TECHNICAL FIELD

This disclosure relates to a high tensile-strength galvanized steel sheet that can be suitably used for automobile parts and other applications that require press forming in a difficult shape. The high tensile-strength (zinc) galvanized steel sheet has excellent formability and weldability, and a tensile strength (TS) of at least 980 MPa. The disclosure also relates to a method for manufacturing the high tensile-strength galvanized steel sheet.

A "galvanized steel sheet" includes a steel sheet that is galvannealed after hot-dip galvanizing, that is, a galvannealed steel sheet.

BACKGROUND

High tensile-strength galvanized steel sheets for use in automobile parts and the like must have excellent formability as well as a high strength because of the characteristics of the applications.

Recently, high tensile-strength steel sheets have been required and increasingly used as materials for automobile bodies to improve fuel efficiency by weight reduction and ensure crashworthiness. Furthermore, while high tensile-strength steel sheets have mainly been used in simple processing applications, they are also being applied to complicated shapes..

However, in general, higher-strength steel sheets tend to have lower formability. In particular, the most important problem in the application of high tensile-strength steel sheets is cracks in press forming. Thus, formability, such as stretch flangeability, must be improved in a manner that depends on the shape of a part. In particular, high tensile-strength steel sheets having a TS of at least 980 MPa are often used in parts that are to be bent. Thus, bendability (synonymous with bending formability) is also important.

Furthermore, after forming of a steel sheet, the steel sheet is subjected to resistance spot welding in an assembly process. Thus, in addition to formability, excellent weldability is also required.

To this end, for example, Japanese Unexamined Patent Application Publications No. 2004-232011, No. 2002-256386, No. 2002-317245, and No. 2005-105367, Japanese Patent No. 3263143 and its Japanese Unexamined Patent Application Publication No. 6-073497, Japanese Patent No. 3596316 and its Japanese Unexamined Patent Application Publication No. 11-236621, and Japanese Unexamined Patent Application Publications No. 2001-11538 and No. 2006-63360 propose a method for manufacturing a high tensile-strength galvanized steel sheet having excellent formability, for example, by defining the steel component and the microstructure or by optimizing hot-rolling conditions or annealing conditions.

Among the publications described above, Japanese Unexamined Patent Application Publication No. 2004-232011 discloses steel having high C and Si contents and of TS 980 MPa grade. However, excellent stretch flangeability or bendability is not the primary objective of Japanese Unexamined Patent Application Publication No. 2004-232011. Furthermore, exemplified compositions have poor platability (require iron-based preplating), and resistance spot weldability is also difficult to achieve.

Japanese Unexamined Patent Application Publication Nos. 2002-256386, 2002-317245 and 2005-105367 disclose steel leveraging Cr. However, excellent stretch flangeability and bendability is not the primary objective of these publications. Furthermore, it is difficult to achieve a TS of at least 980 MPa by these techniques without the addition of a strengthening element in such an amount that the characteristics described above or platability is adversely affected.

Furthermore, Japanese Patent No. 3263143 and its Japanese Unexamined Patent Application Publication No. 6-073497, Japanese Patent No. 3596316 and its Japanese Unexamined Patent Application Publication No. 11-236621 and Japanese Unexamined Patent Application Publication No. 2001-11538 describe a hole expansion ratio λ, which is an indicator of stretch flangeability, but rarely achieve a tensile strength (TS) of 980 MPa. The tensile strength (TS) of 980 MPa is only achieved in Japanese Patent No. 3596316 by the addition of large amounts of C and Al, which is unfavorable to resistance spot weldability. Furthermore, excellent bendability is not the primary objective of Japanese Patent No. 3596316.

Japanese Unexamined Patent Application Publication No. 2006-63360 describes a technique in which bendability or fatigue characteristics are improved by the addition of Ti. However, excellent stretch flangeability or weldability is not the primary objective of Japanese Unexamined Patent Application Publication No. 2006-63360.

In view of the situations described above, it could be helpful to provide a high tensile-strength galvanized steel sheet that has a tensile strength as high as 980 MPa or more and excellent formability and weldability, as well as excellent bendability. It could also be helpful to provide an advantageous method for manufacturing the high tensile-strength galvanized steel sheet.

SUMMARY

As a result of diligent and repeated investigations, we discovered the following findings:

(1) The contents of C, P, and S must be reduced in terms of formability and weldability.

(2) The Si content must be reduced to achieve excellent surface properties and galvanizing ability.

(3) Cr, Nb, Mo, and B can be leveraged to compensate for a reduction in strength associated with a reduction in content of C, P, and other elements. Thus, a high strength of at least 980 MPa can be achieved at a low content of alloying element.

(4) A microstructure that contains 20% to 70% by volume ferrite having an average grain size of 5 μm or less provides improved formability and weldability.

(5) In addition to (4), a microstructure that contains 30% to 80% by volume bainite and/or martensite each having an average grain size of 5 μm or less provides improved bendability.

We thus provide:

1. A high tensile-strength galvanized steel sheet having excellent formability and weldability, containing: as a percentage of mass, C: at least 0.05% but less than 0.12%, Si: at least 0.01% but less than 0.35%, Mn: 2.0% to 3.5%, P: 0.001% to 0.020%, S: 0.0001% to 0.0030%, Al: 0.005% to 0.1%, N: 0.0001% to 0.0060%, Cr: more than 0.5% but not more than 2.0%, Mo: 0.01% to 0.50%, Ti: 0.010% to 0.080%, Nb: 0.010% to 0.080%, and B: 0.0001% to 0.0030%, the remainder being Fe and unavoidable impurities, having a microstructure that contains 20% to 70% by volume ferrite having an average grain size of 5 μm or less, a tensile strength of at least 980 MPa, and a galvanized zinc layer at a coating weight in a range of 20 to 150 g/m$^2$ (per side) on a surface thereof.

Preferably, the high tensile-strength galvanized steel sheet contains C: at least 0.05% but less than 0.10%, S: 0.0001% to 0.0020%, and N: 0.0001% to 0.0050%, and the volume fraction of ferrite is in the range of 20% to 60%.

2. A high tensile-strength galvanized steel sheet having excellent formability and weldability, containing: as a percentage of mass, C: at least 0.05% but less than 0.12%, Si: at least 0.01% but less than 0.35%, Mn: 2.0% to 3.5%, P: 0.001% to 0.020%, S: 0.0001% to 0.0030%, Al: 0.005% to 0.1%, N: 0.0001% to 0.0060%, Cr: more than 0.5% but not more than 2.0%, Mo: 0.01% to 0.50%, Ti: 0.010% to 0.080%, Nb: 0.010% to 0.080%, and B: 0.0001% to 0.0030%, the remainder being Fe and unavoidable impurities, and containing, as a percentage by volume, 20% to 70% ferrite having an average grain size of 5 μm or less; and 30% to 80% bainite and/or martensite each having an average grain size of 5 μm or less, wherein the amount of remaining microstructure is 5% or less (including zero), and the high tensile-strength galvanized steel sheet has a tensile strength of at least 980 MPa and has a galvanized zinc layer at a coating weight in a range of 20 to 150 g/m$^2$ (per side) on a surface thereof.

3. A process for manufacturing a high tensile-strength galvanized steel sheet having excellent formability and weldability, subjecting a steel slab to a hot-rolling process, coilding, cold-rolling, and galvanizing to manufacture the galvanized steel sheet, the steel slab containing, as a percentage of mass, C: at least 0.05% but less than 0.12%, Si: at least 0.01% but less than 0.35%, Mn: 2.0% to 3.5%, P: 0.001% to 0.020%, S: 0.0001% to 0.0030%, Al: 0.005% to 0.1%, N: 0.0001% to 0.0060%, Cr: more than 0.5% but not more than 2.0%, Mo: 0.01% to 0.50%, Ti: 0.010% to 0.080%, Nb: 0.010% to 0.080%, and B: 0.0001% to 0.0030%, the remainder being Fe and unavoidable impurities, wherein, in the hot-rolling, the slab is hot-rolled at a slab reheating temperature (SRT) in a range of 1150° C. to 1300° C. and a finishing temperature (FT) in a range of 850° C. to 950° C., is then cooled from the finishing temperature to (finishing temperature—100° C.) at an average cooling rate in a range of 5° C. to 200° C./s, and is coiled at a temperature in a range of 400° C. to 650° C., and after cold rolling, the slab is heated from 200° C. to an intermediate temperature at a first average heating rate in a range of 5° C. to 50° C./s, the intermediate temperature being in a range of 500° C. to 800° C., heated from the intermediate temperature to an annealing temperature at a second average heating rate in a range of 0.1° C. to 10° C./s, the annealing temperature being in a range of 750° C. to 900° C., held in the annealing temperature range for 10 to 500 seconds, cooled to a temperature in a range of 450° C. to 550° C. at an average cooling rate in a range of 1° C. to 30° C./s, and then subjected to hot-dip galvanizing and, optionally, alloying.

Preferably, the slab contains C: at least 0.05% but less than 0.10%, S: 0.0001% to 0.0020%, and N: 0.0001% to 0.0050%, the temperature at which a hot-rolled steel sheet is coiled is in the range of 400° C. to 600° C., and the first average heating rate is in the range of 10° C. to 50° C./s. Furthermore, before cold rolling, a hot-rolled steel sheet may be pickled to remove an oxidized layer on the surface thereof.

The term "excellent formability," as used herein, means that an object satisfies TS×El≧15000 MPa·%, TS×λ≧43000 MPa·%, and desirably a critical bending radius ≦1.5t (t: thickness of steel sheet) in 90° bending. The term "excellent weldability," as used herein, means that a base metal is broken at a nugget diameter of at least $4t^{1/2}$ (mm) (t: thickness of steel sheet). The term "high-strength (high tensile-strength)," as used herein, means that the tensile strength (TS) is at least 980 MPa.

DETAILED DESCRIPTION

Our steel sheets and methods will be further described below.

Chemical Composition of Steel Sheet

The chemical composition of a steel sheet is limited to the above-mentioned range for the following reasons. Unless otherwise specified, the "%" of a component means % by mass.

C: at least 0.05% but less than 0.12%

The strength of martensite has a tendency to increase in proportion to the C content. C is therefore an essential element to strengthen steel using martensite. At least 0.05% C is necessary to achieve a TS of at least 980 MPa. The TS increases with the C content. However, at a C content of 0.12% or more, the spot weldability deteriorates greatly. Furthermore, the hardening of steel by increase in amount of martensite, and the formation of retained austenite which will be transformed into hard martensite during deformation, also tend to cause marked deterioration of formability, such as stretch flangeability. Hence, the C content is limited to at least 0.05% but less than 0.12%. More preferably, the C content is less than 0.10%. On the other hand, the C content is preferably at least 0.08% to consistently achieve a TS of at least 980 MPa.

Si: at least 0.01% but less than 0.35%

Si contributes to improved strength through solid solution strengthening. However, a Si content of less than 0.01% has a less effect, and that of 0.35% or more has a saturated effect. Furthermore, during a hot-rolling process, an excessive amount of Si results in the formation of scale (oxide film) that is difficult to remove, thus causing deterioration of the surface properties of a steel sheet. Furthermore, because Si is concentrated on the surface of a steel sheet as an oxide, an excessive amount of Si results in the formation of an ungalvanized surface. Hence, the Si content is limited to at least 0.01% but less than 0.35%. Preferably, the Si content is in the range of 0.01% to 0.20%.

Mn: 2.0% to 3.5%

Mn effectively improves the strength at a content of at least 2.0%. However, a Mn content of more than 3.5% results in the segregation of Mn, causing unevenness in transformation point over the microstructure. This results in a heterogeneous banded microstructure of ferrite and martensite, thus lowering the formability. Furthermore, Mn is concentrated on the surface of a steel sheet as an oxide, causing an ungalvanized surface. In addition, an excessive amount of Mn reduces the toughness of a spot-welded area and causes deterioration of welding characteristics. Hence, the Mn content is limited to 2.0% or more and 3.5% or less. More preferably, the lower limit is at least 2.2%, and the upper limit is 2.8% or less.

P: 0.001% to 0.020%

P improves the strength, but causes deterioration of weldability which is noticeable at a P content of more than 0.020%. On the other hand, an excessive reduction in P content increases manufacturing costs in a steelmaking process. Hence, the P content is limited to 0.001% or more and 0.020% or less. The P content is preferably in the range of 0.001% to 0.015% and more preferably in the range of 0.001% to 0.010%.

S: 0.0001% to 0.0030%

An increase in S content may cause red shortness and failure in a manufacturing process. Furthermore, an increase in S content results in the formation of an inclusion of MnS. MnS is formed as a plate inclusion after cold rolling. In particular, MnS causes deterioration of the ultimate ductility and the formability, such as stretch flangeability, of a material. However, these adverse effects are relatively small at a S content of 0.0030% or less. On the other hand, an excessive reduction in S content increases a desulfurization cost in a steel manufacturing process. Hence, the S content is limited to 0.0001% or more and 0.0030% or less. More preferably, the S content is in the range of 0.0001% to 0.0020%. Still more preferably, the S content is in the range of 0.0001% to 0.0015%.

Al: 0.005% to 0.1%

Al is effective as a deoxidizer in a steel manufacturing process and is also useful in separating nonmetal inclusions, as slag, that lower local ductility. Furthermore, Al prevents the formation of a Mn oxide or a Si oxide, which reduces galvanizing ability, on a surface layer of a steel sheet during an annealing process, thus improving the appearance of a galvanized surface. This effect requires the addition of at least 0.005% Al. However, the addition of more than 0.1% Al results in an increase in steel cost and poor weldability. Hence, the Al content is limited to 0.005% to 0.1%. More preferably, the lower limit is at least 0.01%, and the upper limit is 0.06% or less.

N: 0.0001% to 0.0060%

While N does not have significant effects on the material properties of microstructure-strengthened steel, N does not reduce steel sheet characteristics at a content of 0.0060% or less. On the other hand, while it is desirable that the N content be reduced to improve ductility through the purification of ferrite, this increases manufacturing costs. Thus, the lower limit is set at 0.0001%. Thus, the N content is in the range of 0.0001% or more and 0.0060% or less. Preferably, the N content is in the range of 0.0001% to 0.0050%.

Cr: More than 0.5% but not More than 2.0%

Cr is effective for quench hardening of the steel. Furthermore, Cr improves the hardenability of austenite. Cr uniformly and finely disperses a harder phase (martensite, bainite, or retained austenite) and thereby effectively improves elongation, stretch flangeability, and bendability. These effects require the addition of more than 0.5% Cr. However, at a Cr content of more than 2.0%, these effects level off, and the surface quality is reduced greatly. Hence, the Cr content is limited to more than 0.5% but not more than 2.0%. More preferably, the Cr content is more than 0.5% but not more than 1.0%.

Mo: 0.01% to 0.50%

Mo is effective for quench hardening of the steel, and easily ensures a high strength and thereby improves weldability in low-carbon steel. These effects require the addition of at least 0.01% Mo. However, at a Mo content of more than 0.50%, these effects level off, and the steel cost increases. Hence, the Mo content is limited to 0.01% to 0.50%. More preferably, the lower limit is at least 0.05%, and the upper limit is 0.35% or less. Still more preferably, the upper limit is 0.20%.

Ti: 0.010% to 0.080%

Ti forms fine carbide or fine nitride in steel, thus effectively contributing to a reduction in grain size (grain refining) and precipitation hardening in a hot-rolled sheet microstructure and an annealed steel sheet microstructure. These effects require at least 0.010% Ti. However, at a Ti content of more than 0.080%, these effects level off, and an excessive amount of precipitate is produced in ferrite, thus lowering the ductility of the ferrite. Hence, the Ti content is limited to 0.010% to 0.080%. More preferable lower limit is at least 0.020%, and more preferable upper limit is 0.060% or less.

Nb: 0.010% to 0.080%

Nb improves the strength through solid solution strengthening or precipitation hardening. Furthermore, Nb strengthens ferrite phase and thereby reduces a difference in hardness between ferrite and martensite, thus effectively contributing to improved stretch flangeability. Furthermore, Nb contributes to a reduction in grain size of ferrite and bainite/martensite, and also improves the bendability. These effects are achieved at a Nb content of at least 0.010%.

However, Nb of more than 0.080% hardens the hot-rolled sheet and increases the load in hot rolling and cold rolling. Furthermore, Nb of more than 0.080% reduces the ductility of ferrite, thus lowering the formability. Hence, the Nb content is limited to 0.010% or more and 0.080% or less. In terms of strength and formability, more preferably, the lower limit of the Nb content is at least 0.030%, and the upper limit is 0.070% or less.

B: 0.0001% to 0.0030%

B improves the quench-hardenability and prevents the generation of ferrite in a cooling process after annealing at high temperature, thus contributing to the formation of a desired amount of martensite. These effects require at least 0.0001% B. However, these effects level off at a B content of more than 0.0030%.

Hence, the B content is limited to 0.0001% to 0.0030%. More preferably, the lower limit is at least 0.0005%, and the upper limit is 0.0020% or less.

Preferably, a steel sheet contains C: at least 0.05% but less than 0.10%, S: 0.0001% to 0.0020%, and N: 0.0001% to 0.0050%.

Our steel sheets essentially have the composition described above to achieve desired formability and weldability. The remainder is Fe and unavoidable impurities. If necessary, the steel sheets may also contain the following elements.

Ca controls the shape of sulfide, such as MnS, to improve the ductility. However, this effect levels off at a certain amount of Ca. Hence, if present, the Ca content is 0.0001% or more and 0.0050% or less, and more preferably in the range of 0.0001% to 0.0020%.

V forms carbide and thereby strengthens ferrite. However, V lowers the ductility of ferrite. Hence, if present, the V content is less than 0.05% and more preferably less than 0.005%. Preferably, the lower limit is 0.001%.

REM controls the shape of sulfide inclusions without altering the galvanizing ability significantly, thus effectively contributing to improved formability. Thus, the REM content is preferably in the range of 0.0001% to 0.1%.

Sb narrows the crystal size distribution of a surface layer of a steel sheet. Thus, the Sb content is preferably in the range of 0.0001% to 0.1%.

The contents of Zr, Mg, and other elements that produce a precipitate are preferably as small as possible. Thus, there is no need to add these elements deliberately. Their permissible contents are preferably less than 0.0200% and more preferably less than 0.0002%.

Cu and Ni adversely affect the weldability and the surface appearance after galvanizing, respectively. Their permissible contents are preferably less than 0.4% and more preferably less than 0.04%.

Microstructure of Steel

The scope of the steel microstructure, which is one of the important requirements, and the reason for defining the scope will be described below.

Volume Fraction of Ferrite: 20% to 70%

Ferrite is a soft phase and improves the ductility of a steel sheet. Thus, a steel sheet must contain at least 20% by volume ferrite. However, more than 70% ferrite softens a steel sheet excessively. Thus, it is difficult to secure a high strength. Hence, the volume fraction of ferrite is in the range of 20% or more and 70% or less. More preferably, the lower limit is at least 30%. The upper limit is preferably 60% or less and more preferably 50% or less.

Average Grain Size of Ferrite: 5 μm or Less

A finer microstructure contributes to improved stretch flangeability and bendability of a steel sheet. Thus, the average grain size of ferrite (that is, the average size of ferrite grains in ferrite) in a composite microstructure is limited to 5 μm or less to improve such as bendability.

The presence of coarse soft domains and coarse hard domains (that is, soft domains and hard domains are separated from each other as coarse domains) results in poor formability because of uneven deformation of microstructure. In this respect, the presence of ferrite and a hard phase in a fine and uniform manner allows uniform deformation of a steel sheet during press forming. It is therefore desirable that the average grain size of ferrite be small. The more preferred upper limit to prevent the deterioration of formability is 3.5 μm. The preferred lower limit is 1 μm.

Volume Fraction of Bainite and/or Martensite: 30% to 80%

As a microstructure other than ferrite described above, a microstructure preferably contains 30% to 80% by volume in total of at least one of bainite and martensite (hereinafter generally referred to as "bainite and/or martensite"), which are low-temperature transformation phases from austenite. The martensite, as used herein, means martensite that is not tampered. Such a microstructure provides a high-quality material.

This bainite and/or martensite is a hard phase which increases the strength of a steel sheet. Furthermore, the formation of these hard phases through transformation is accompanied by the generation of mobile dislocation. Thus, the bainite and/or martensite also reduces the yield ratio of a steel sheet.

However, at a bainite and/or martensite content of less than 30% by volume, these effects are insufficient. On the other hand, a bainite and/or martensite content of more than 80% results in an excessive amount of hard phase. Thus, it is difficult to secure high formability. Furthermore, a heat-affected zone becomes soft during spot welding, and, in a cross tensile test, breakage occurs at a weld (inside a nugget) rather than in a base metal.

Average Grain Size of Bainite and/or Martensite: 5 μm or Less

A uniform microstructure contributes particularly to improved bendability. The average grain size of not only ferrite, but also bainite and/or martensite in a composite microstructure is limited more preferably to 5 μm or less and still more preferably to 3.5 μm or less. The preferred lower limit is 1 μm.

While the term grain size is used following general usage, the grain size is practically measured on a region corresponding to a prior austenite grain size before transformation while considering the region as a crystal grain.

The remaining microstructure other than the ferrite, bainite, and martensite described above includes retained austenite and pearlite. When the total amount of these domains is 5% by volume or less (including 0%, that is, absent), they do not reduce the characteristics of the steel sheets.

When the TS is prior to other properties, preferably, the main phase other than ferrite is martensite, and the volume fraction of the martensite is in the range of 40% to 80% by volume (thus, the total amount of bainite, retained austenite, and other phases is 5% by volume or less (including 0%)).

Manufacturing Method

A suitable method for manufacturing a high tensile-strength galvanized steel sheet will be described below.

First, a slab is manufactured by a continuous casting process or an ingot-making and blooming process from molten steel prepared to have a suitable composition described above. The slab is then cooled, reheated, and hot-rolled. Alternatively, the slab is directly hot-rolled without heat treatment (so-called direct rolling process). The slab reheating temperature SRT is in the range of 1150° C. to 1300° C. The finishing temperature FT is in the range of 850° C. to 950° C. to form a uniform microstructure of a hot-rolled sheet and improve the formability, such as stretch flangeability. The average cooling rate between the finishing temperature and (finishing temperature—100° C.) is in the range of 5° C. to 200° C./s to prevent the formation of a banded microstructure (in this case, composed of ferrite and pearlite/bainite, which is harder than ferrite), forming a uniform microstructure of a hot-rolled sheet, and improve the formability, such as stretch flangeability. The coiling temperature (CT) is in the range of 400° C. to 650° C. to improve the surface properties and the cold rollability. After hot rolling is completed under these conditions, if necessary, the hot-rolled sheet is subjected to pickling. The hot-rolled sheet is then cold-rolled into a desired thickness. The cold rolling reduction is desirably at least 30% to promote the recrystallization of ferrite during an annealing process, thus improving the ductility.

In an annealing (y region or two-phase annealing) and hot-dip galvanizing process, annealing is performed under the following conditions to control the microstructure of an annealed steel sheet before cooling and thereby optimize the volume fraction and the grain size of ferrite finally formed:

- A first average heating rate between 200° C. and an intermediate temperature: 5° C. to 50° C./s
- The intermediate temperature: 500° C. to 800° C.
- A second average heating rate between the intermediate temperature and an annealing temperature: 0.1° C. to 10° C./s
- The annealing temperature: 750° C. to 900° C., held at this temperature for 10 to 500 seconds.

After holding, a steel sheet is cooled to a cooling stopping temperature in the range of 450° C. to 550° C. at an average cooling rate in the range of 1° C. to 30° C./s.

After cooling, the steel sheet is dipped in a hot-dip galvanizing bath. The coating weight is controlled, for example, by gas wiping. If necessary, the steel sheet is heated and alloying treatment is conducted. The steel sheet is then cooled to room temperature.

The average cooling rate and the average heating rate are defined by dividing the temperature change by the time required.

In this way, a high tensile-strength galvanized steel sheet is manufactured. A galvanized steel sheet may be subjected to skin pass rolling.

The scope of the manufacturing conditions and the reason for defining the scope will be more specifically described below.

Slab Reheating Temperature SRT: 1150° C. to 1300° C.

A precipitate remaining after heating of a steel slab is present as a coarse precipitate in a final steel sheet product and does not contribute to high strength. Thus, it is necessary to resolve a Ti or Nb precipitate, which is formed in a casting process, in a slab heating process to allow finer precipitation in a subsequent process.

In this case, heating at 1150° C. or more contributes to high strength. Furthermore, it is also advantageous to heat a steel sheet at 1150° C. or more so that defects, such as air bubbles and segregation, formed in a slab surface layer is scaled off (form an iron oxide layer and then remove the layer) to reduce cracks and bumps and dips on the steel sheet surface, thus providing a flat and smooth surface.

However, a reheating temperature of more than 1300° C. causes coarsening of austenite, which results in coarsening of final microstructure, thus reducing the stretch flangeability and the bendability. Hence, the slab reheating temperature is limited to 1150° C. or more and 1300° C. or less.

Finishing Temperature FT: 850° C. to 950° C.

A finishing temperature of at least 850° C. can remarkably improve the formability (ductility, stretch flangeability, and the like). A finishing temperature of less than 850° C. causes an elongated non-recrystallizing microstructure after hot rolling. Furthermore, when an austenite-stabilizing element Mn is segregated in a cast piece (slab), the Ar3 transformation point of the segregated region is lowered and the austenite region is expanded to low temperature. A reduction in transformation temperature may equalize the non-recrystallization temperature range to the final rolling temperature. Thus, non-recrystallized austenite may be formed by hot rolling. A hot-rolled steel sheet and accordingly a final steel sheet product having a heterogeneous microstructure thus formed cannot be deformed uniformly by press forming and is difficult to achieve high formability.

On the other hand, a finishing temperature of more than 950° C. results in a drastic increase in oxide (scale) production and a rough metal-iron/oxide interface. Thus, even after pickling, the quality of a cold-rolled surface tends to deteriorate. Further, if hot-rolling scale remains after pickling, is has adverse effects on resistance spot weldability. Furthermore, an excessively high finishing temperature results in excessively coarse crystal grains. Thus, a pressed final steel sheet product may have an orange peel surface. Hence, the finishing temperature is in the range of 850° C. to 950° C. and preferably in the range of 900° C. to 950° C.

Average Cooling Rate Between Finishing Temperature and (Finishing Temperature—100° C.): 5° C. to 200° C./s When the cooling rate in a high-temperature region [between finishing temperature and (finishing temperature—100° C.)] immediately after finish rolling is less than 5° C./s, recrystallization and grain growth are promoted after hot-rolling. This coarsens the hot-rolled sheet microstructure. Furthermore, a banded microstructure composed of ferrite and pearlite is formed. When the banded microstructure is formed before annealing, the steel sheet is annealed in the presence of inconsistencies in concentration of its components. Thus, it is difficult to form a fine and uniform microstructure. Consequently, the final microstructure becomes heterogeneous, and the stretch flangeability and the bendability deteriorate. Thus, the average cooling rate between the finishing temperature and (finishing temperature—100° C.) is at least 5° C./s. On the other hand, at an average cooling rate of more than 200° C./s in the temperature range, the effects tend to level off, and problems regarding facility costs and the shape of a steel sheet arise. Hence, the average cooling rate in this temperature range is in the range of 5° C. to 200° C./s. Preferably, the lower limit is 10° C./s. The upper limit is preferably 100° C./s and more preferably 50° C./s.

Coiling Temperature CT: 400° C. to 650° C.

At a coiling temperature CT of more than 650° C., the thickness of scale deposited on the surface of a hot-rolled sheet increases. Thus, even after pickling, a cold-rolled steel sheet has a rough surface including bumps and dips and therefore has poor formability. Furthermore, hot-rolling scale remaining after pickling has adverse effects on resistance spot weldability. On the other hand, a coiling temperature of less than 400° C. results in an increase in strength of a hot-rolled sheet, which increases rolling load in cold rolling, thus reducing the productivity. Hence, the coiling temperature is in the range of 400° C. or more and 650° C. or less and preferably in the range of 400° C. to 600° C.

First Average Heating Rate (Between 200° C. and Intermediate Temperature): 5° C. to 50° C./s Intermediate Temperature: 500° C. to 800° C.

Second Average Heating Rate (Between Intermediate Temperature and Annealing Temperature): 0.1° C. to 10° C./s A first heating rate of at least 5° C./s results in a fine microstructure, thus improving the stretch flangeability and the bendability. The first heating rate may be high. However, the effects level off at a first heating rate of more than 50° C./s. Hence, the first average heating rate is in the range of 5° C. to 50° C./s and preferably 10° C./s.

An intermediate temperature of more than 800° C. results in coarse crystal grains, thus lowering the stretch flangeability and the bendability. While the intermediate temperature may be low, at an intermediate temperature of less than 500° C., the effects level off, and the final microstructure does not change significantly with the intermediate temperature. Hence, the intermediate temperature is in the range of 500° C. to 800° C. The holding time at the intermediate temperature is substantially zero.

At a second average heating rate of more than 10° C./s, austenite generates slowly. This increases the final ferrite fraction and makes it difficult to achieve a high strength. On the other hand, a second average heating rate of less than 0.1° C./s results in coarse crystal grains, thus lowering the stretch flangeability and the bendability. Hence, the second average heating rate is in the range of 0.1° C. to 10° C./s, preferably less than 10° C./s, and more preferably less than 5° C./s.

Preferably, the first average heating rate is higher than the second average heating rate. More preferably, the first average heating rate is at least five times the second average heating rate.

Annealing Temperature: 750° C. to 900° C., Held at this Temperature for 10 to 500 Seconds An annealing temperature of less than 750° C. results in the formation of non-recrystallized ferrite (a region in which a strain generated by cold working is not relieved). Thus, the formability, such as the elongation and the hole expansion ratio, deteriorate. On the other hand, an annealing temperature of more than 900° C. results in the formation of coarse austenite during heating. This reduces the amount of ferrite in a subsequent cooling process and reduces elongation. Furthermore, the final crystal grain size tends to become excessively large, and the hole expansion ratio and the bendability deteriorate. Hence, the annealing temperature is in the range of 750° C. or more and 900° C. or less.

Furthermore, when the holding time at the annealing temperature range is less than 10 seconds, carbide is more likely to remain undissolved, and the amount of austenite may be reduced during the annealing process or at an initial cooling temperature. This makes it difficult to achieve a high strength of a final steel sheet product. The crystal grain has a tendency to grow with annealing time. When the holding time at the annealing temperature range exceeds 500 seconds, the austenite grain size becomes coarse during the annealing process. Thus, a final steel sheet product after heat treatment tends to have a coarse microstructure, and the hole expansion ratio and the bendability deteriorate. In addition, coarsening of austenite grains may cause orange peel after press forming and is therefore unfavorable. Furthermore, because the amount of ferrite formed during a cooling process is also reduced, the elongation also tends to be reduced.

Hence, the holding time is set at 10 seconds or more and to 500 seconds or less to provide a finer microstructure and, at the same time, reduce the effects of the microstructure before annealing to achieve a fine and uniform microstructure. The lower limit of the holding time is more preferably at least 20 seconds. The upper limit of the holding time is more preferably 200 seconds or less. Furthermore, variations in annealing temperature in the annealing temperature range are preferably within 5° C.

Average Cooling Rate to Cooling Stopping Temperature: 1° C. to 30° C./s

The cooling rate after the holding plays an important role in controlling the ratio of soft ferrite to hard bainite and/or martensite and securing a TS of at least 980 MPa and formability. More specifically, an average cooling rate of more than 30° C./s results in reduced formation of ferrite and excessive formation of bainite and/or martensite. Thus, although the TS of 980 MPa is easily achieved, the formability deteriorates. On the other hand, an average cooling rate of less than 1° C./s may result in excessive formation of ferrite during cooling, leading to a low TS. The lower limit of the average cooling rate is more preferably at least 5° C./s. The upper limit of the average cooling rate is more preferably 20° C./s or less.

While the cooling is preferably performed by gas cooling, it may be furnace cooling, mist cooling, roll cooling, or water cooling, alone or in combination.

Cooling Stopping Temperature: 450° C. to 550° C.

At a cooling stopping temperature of more than 550° C., transformation from austenite to pearlite or bainite, which is softer than martensite, proceeds excessively, and therefore the TS of 980 MPa is difficult to achieve. Furthermore, the excessive formation of retained austenite results in low stretch flangeability. On the other hand, at a cooling stopping temperature of less than 450° C., ferrite is excessively formed during cooling, and the TS of 980 MPa is difficult to achieve.

After the cooling is stopped, common hot-dip galvanizing is performed to provide hot-dip galvanizing. Or, optionally, after the hot-dip galvanizing, alloying treatment is further performed to provide a galvannealed steel sheet. The alloying treatment is performed by reheating, for example, using an induction heating apparatus.

The coating weight in hot-dip galvanizing must be about 20 to 150 g/m$^2$ per side. It is difficult to ensure corrosion resistance at a coating weight of less than 20 g/m$^2$. On the other hand, at a coating weight of more than 150 g/m$^2$, the anticorrosive effect levels off, and manufacturing costs increase.

After continuous annealing, a final galvanized steel sheet product may be subjected to temper rolling to adjust the shape or the surface roughness. However, excessive skin pass rolling causes excessive strain and elongates crystal grains, thus forming a rolled microstructure. This results in reduced ductility. Thus, the skin pass rolling reduction is preferably in the range of about 0.1% to 1.5%.

Thus, a galvanized steel sheet can be manufactured by the method described above. In particular, the galvanized steel sheet is suitably manufactured at a coiling temperature CT: 400° C. to 600° C. and a first average heating rate (200° C. to an intermediate temperature): 10° C. to 50° C./s.

EXAMPLES

Example 1

Steel having the composition shown in Tables 1 and 2 was melted to form a slab. The slab was subjected to hot rolling, pickling, cold rolling at a reduction of 50%, continuous annealing, and galvanizing under various conditions shown in Tables 3 to 6. Galvanized steel sheets and galvannealed steel sheets thus manufactured had a thickness of 1.4 mm and a coating weight of 45 g/m$^2$ per side.

The material properties of the galvanized steel sheets and the galvannealed steel sheets were examined in material tests as described below.

Tables 7 to 10 show the results.

The material tests and methods for evaluating the material properties are as follows:

(1) Microstructure of Steel Sheet

A cross section of a sheet in the rolling direction at a quarter of its thickness was examined by optical microscope or scanning electron microscope (SEM) observation. The crystal grain size of ferrite was determined by a method in accordance with JIS Z 0552, and was converted to an average grain size. The volume fraction of ferrite was determined as a percent area of ferrite in an arbitrary predetermined 100 mm×100 mm square area by the image analysis of a photograph of a cross-sectional microstructure at a magnification of 1000.

The total volume fraction of bainite and martensite was determined by determining the area other than ferrite and pearlite in the same way as ferrite and subtracting a retained austenite fraction from the area. The retained austenite fraction was determined by analyzing a chemically-polished surface of a steel sheet at a quarter of its thickness with an X-ray diffractometer using a Mo $K_\alpha$ line to measure the integrated intensities of (200), (220), and (311) faces of a face-centered cubic (fcc) iron and (200), (211), and (220) faces of a body-centered cubic (bcc) iron. The average grain size of bainite and/or martensite was determined by determining the average grain size of the area other than ferrite and pearlite in the same way as ferrite by the cross-sectional microstructure observation.

(2) Tensile Properties (Yield Strength YS, Tensile Strength TS, and Elongation El)

Tensile properties were evaluated in a tensile test in accordance with JIS Z 2241 using a No. 5 test specimen specified by Ms Z 2201 in a longitudinal direction (tensile direction) perpendicular to the rolling direction. The tensile properties were rated good when TS×El was at least 15000 MPa·%.

(3) Hole Expansion Ratio

The following measurement was performed as described below in accordance with the Japan Iron and Steel Federation standard JFST1001. A hole having an initial diameter $d_0$ of 10 mm was punched and was expanded by raising a 60° conical punch. The punch was stopped when a crack passes through the whole thickness of the sheet. The diameter d of the punched hole was measured, and the hole expansion ratio was calculated using the following equation:

$$\text{Hole expansion ratio (\%)}=((d-d_0)/d_0)\times 100.$$

This test was performed three times with steel sheets of the same number to determine the mean value (λ) of the hole expansion ratio. The hole expansion ratio was rated good when TS×λ was at least 43000 MPa·%.

(4) Critical Bending Radius

A critical bending radius was measured by a V-block method in accordance with JIS Z 2248. An outside of a bend was visually inspected for cracks. A minimum bend radius at which no crack occurs was taken as a critical bending radius.

(5) Resistance Spot Weldability

First, spot welding was performed under the conditions as follows: electrode: DR6 mm-40R, pressure: 4802 N (490 kgf), squeeze time: 30 cycles/60 Hz, weld time: 17 cycles/60 Hz, and holding time: 1 cycle/60 Hz. For steel sheets having the same number, the test current was altered from 4.6 to 10.0 kA in increments of 0.2 kA and from 10.5 kA to Sticking in increments of 0.5 kA.

Welded pieces were subjected to a cross-tension test. The nugget diameter of a weld was also measured. The cross-tension test of a resistance spot welded joint was performed in accordance with JIS Z 3137.

The nugget diameter was examined as described below in accordance with JIS Z 3139. After resistance spot welding, a half of a symmetrical circular plug was cut at a cross section perpendicular to the sheet surface and passing through almost the center of a welding point by an appropriate method. After the cross section was polished and etched, the nugget diameter was determined by observing the cross-sectional microstructure with an optical microscope. The maximum diameter of a fusion zone except a corona bond was taken as the nugget diameter. In a cross-tension test of a welded sheet having a nugget diameter of at least $4t^{1/2}$ (mm) (t: thickness of a steel sheet), the weldability was rated good when a base metal was broken.

TABLE 1

| | Composition (part 1) (% by mass) | | | | | | | |
|---|---|---|---|---|---|---|---|---|
| Type of steel | C | Si | Mn | P | S | Al | N | Note |
| A | 0.051 | 0.15 | 2.35 | 0.008 | 0.0008 | 0.035 | 0.0045 | Inventive example |
| B | 0.099 | 0.10 | 2.25 | 0.009 | 0.0009 | 0.040 | 0.0041 | Inventive example |
| C | 0.085 | 0.30 | 2.35 | 0.008 | 0.0008 | 0.045 | 0.0038 | Inventive example |
| D | 0.080 | 0.01 | 2.45 | 0.007 | 0.0007 | 0.050 | 0.0035 | Inventive example |
| E | 0.095 | 0.25 | 2.15 | 0.006 | 0.0009 | 0.045 | 0.0044 | Inventive example |
| F | 0.055 | 0.15 | 2.95 | 0.007 | 0.0008 | 0.045 | 0.0048 | Inventive example |
| G | 0.070 | 0.05 | 2.38 | 0.009 | 0.0008 | 0.035 | 0.0042 | Inventive example |
| H | 0.060 | 0.10 | 2.65 | 0.008 | 0.0007 | 0.045 | 0.0045 | Inventive example |
| I | 0.055 | 0.20 | 2.15 | 0.009 | 0.0008 | 0.035 | 0.0039 | Inventive example |
| J | 0.065 | 0.30 | 2.55 | 0.008 | 0.0009 | 0.040 | 0.0045 | Inventive example |
| K | 0.065 | 0.10 | 2.15 | 0.007 | 0.0008 | 0.050 | 0.0041 | Inventive example |
| L | 0.850 | 0.15 | 2.30 | 0.006 | 0.0007 | 0.045 | 0.0038 | Inventive example |
| M | 0.095 | 0.05 | 2.25 | 0.007 | 0.0009 | 0.045 | 0.0035 | Inventive example |
| N | 0.090 | 0.15 | 2.20 | 0.008 | 0.0008 | 0.040 | 0.0044 | Inventive example |
| O | 0.075 | 0.25 | 2.35 | 0.009 | 0.0008 | 0.035 | 0.0048 | Inventive example |
| P | 0.070 | 0.30 | 2.40 | 0.008 | 0.0007 | 0.040 | 0.0042 | Inventive example |
| Q | 0.060 | 0.20 | 2.50 | 0.007 | 0.0008 | 0.035 | 0.0045 | Inventive example |
| R | 0.070 | 0.10 | 2.60 | 0.006 | 0.0009 | 0.040 | 0.0035 | Inventive example |
| S | 0.080 | 0.05 | 2.25 | 0.005 | 0.0008 | 0.045 | 0.0044 | Inventive example |
| T | 0.125 | 0.05 | 2.25 | 0.006 | 0.0007 | 0.050 | 0.0048 | Comparative example |
| U | 0.080 | 0.05 | 2.70 | 0.007 | 0.0009 | 0.045 | 0.0042 | Comparative example |
| V | 0.085 | 0.15 | 2.70 | 0.008 | 0.0008 | 0.045 | 0.0045 | Comparative example |
| W | 0.052 | 0.01 | 3.65 | 0.009 | 0.0008 | 0.040 | 0.0039 | Comparative example |

| | Composition (part 2) (% by mass) | | | | | | |
|---|---|---|---|---|---|---|---|
| Type of steel | Cr | Mo | Ti | Nb | B | Ca | Note |
| A | 0.95 | 0.08 | 0.045 | 0.065 | 0.0014 | tr. | Inventive example |
| B | 0.55 | 0.08 | 0.042 | 0.055 | 0.0012 | tr. | Inventive example |
| C | 0.62 | 0.08 | 0.038 | 0.048 | 0.0011 | tr. | Inventive example |
| D | 0.65 | 0.08 | 0.036 | 0.052 | 0.0009 | tr. | Inventive example |
| E | 0.68 | 0.08 | 0.034 | 0.056 | 0.0009 | tr. | Inventive example |
| F | 0.65 | 0.08 | 0.032 | 0.062 | 0.0009 | 0.0008 | Inventive example |
| G | 0.58 | 0.08 | 0.034 | 0.068 | 0.0008 | tr. | Inventive example |
| H | 0.55 | 0.08 | 0.036 | 0.072 | 0.0013 | tr. | Inventive example |
| I | 1.55 | 0.08 | 0.038 | 0.061 | 0.0011 | tr. | Inventive example |
| J | 0.66 | 0.08 | 0.044 | 0.047 | 0.0012 | tr. | Inventive example |
| K | 0.51 | 0.45 | 0.035 | 0.048 | 0.0014 | tr. | Inventive example |
| L | 0.61 | 0.08 | 0.021 | 0.039 | 0.0009 | tr. | Inventive example |
| M | 0.65 | 0.08 | 0.055 | 0.052 | 0.0011 | tr. | Inventive example |
| N | 0.68 | 0.08 | 0.052 | 0.049 | 0.0012 | tr. | Inventive example |
| O | 0.57 | 0.08 | 0.048 | 0.038 | 0.0014 | tr. | Inventive example |
| P | 0.66 | 0.08 | 0.044 | 0.052 | 0.0009 | tr. | Inventive example |
| Q | 0.65 | 0.08 | 0.041 | 0.054 | 0.0008 | tr. | Inventive example |
| R | 0.68 | 0.08 | 0.037 | 0.056 | 0.0008 | tr. | Inventive example |
| S | 0.56 | 0.08 | 0.036 | 0.078 | 0.0022 | tr. | Inventive example |
| T | 0.55 | 0.08 | 0.035 | 0.055 | 0.0012 | tr. | Comparative example |
| U | 0.15 | 0.08 | 0.034 | 0.051 | 0.0014 | tr. | Comparative example |

TABLE 1-continued

| | | | | | | | |
|---|---|---|---|---|---|---|---|
| V | 0.75 | 0.08 | 0.031 | 0.004 | 0.0009 | tr. | Comparative example |
| W | 0.52 | 0.01 | 0.021 | 0.031 | 0.0008 | tr. | Comparative example |

TABLE 2

| Type of | Composition (part 1) (% by mass) | | | | | | | |
|---|---|---|---|---|---|---|---|---|
| Steel | C | Si | Mn | P | S | Al | N | Note |
| X | 0.105 | 0.17 | 2.51 | 0.012 | 0.0015 | 0.045 | 0.0041 | Inventive example |
| Y | 0.092 | 0.13 | 0.42 | 0.015 | 0.0020 | 0.038 | 0.0037 | Inventive example |
| Z | 0.087 | 0.12 | 2.32 | 0.017 | 0.0017 | 0.055 | 0.0020 | Inventive example |
| AA | 0.110 | 0.24 | 2.01 | 0.009 | 0.0025 | 0.027 | 0.0029 | Inventive example |
| AB | 0.082 | 0.22 | 2.09 | 0.008 | 0.0012 | 0.053 | 0.0024 | Inventive example |
| AC | 0.112 | 0.09 | 2.22 | 0.010 | 0.0020 | 0.030 | 0.0037 | Comparative example |
| AD | 0.115 | 0.08 | 2.76 | 0.030 | 0.0040 | 0.044 | 0.0037 | Comparative example |
| AE | 0.118 | 0.11 | 3.30 | 0.014 | 0.0026 | 0.041 | 0.0042 | Comparative example |
| AF | 0.044 | 0.1 | 2.5 | 0.008 | 0.001 | 0.04 | 0.003 | Comparative example |
| AG | 0.09 | 0.1 | 1.8 | 0.008 | 0.001 | 0.04 | 0.003 | Comparative example |
| AH | 0.09 | 0.1 | 2.5 | 0.025 | 0.001 | 0.04 | 0.003 | Comparative example |
| AI | 0.09 | 0.1 | 2.5 | 0.008 | 0.001 | 0.15 | 0.003 | Comparative example |
| AJ | 0.09 | 0.1 | 2.5 | 0.008 | 0.001 | 0.04 | 0.003 | Comparative example |
| AK | 0.09 | 0.1 | 2.5 | 0.008 | 0.001 | 0.04 | 0.003 | Comparative example |
| AL | 0.09 | 0.1 | 2.5 | 0.008 | 0.001 | 0.04 | 0.003 | Comparative example |
| AM | 0.09 | 0.1 | 2.5 | 0.008 | 0.001 | 0.04 | 0.003 | Comparative example |

| Type of | Composition (part 2) (% by mass) | | | | | | |
|---|---|---|---|---|---|---|---|
| Steel | Cr | Mo | Ti | Nb | B | Ca | Note |
| X | 0.74 | 0.101 | 0.025 | 0.016 | 0.0007 | tr. | Inventive example |
| Y | 0.77 | 0.050 | 0.023 | 0.020 | 0.0005 | tr. | Inventive example |
| Z | 0.82 | 0.030 | 0.014 | 0.027 | 0.0012 | tr. | Inventive example |
| AA | 0.87 | 0.121 | 0.012 | 0.035 | 0.0010 | tr. | Inventive example |
| AB | 0.52 | 0.150 | 0.017 | 0.041 | 0.0011 | tr. | Inventive example |
| AC | 0.67 | 0.090 | 0.005 | 0.021 | 0.0009 | tr. | Comparative example |
| AD | 0.72 | 0.110 | 0.013 | 0.015 | 0.0016 | tr. | Comparative example |
| AE | 0.90 | 0.005 | 0.016 | 0.021 | 0.0014 | tr. | Comparative example |
| AF | 0.7 | 0.15 | 0.03 | 0.05 | 0.001 | tr. | Comparative example |
| AG | 0.7 | 0.15 | 0.03 | 0.05 | 0.001 | tr. | Comparative example |
| AH | 0.7 | 0.15 | 0.03 | 0.05 | 0.001 | tr. | Comparative example |
| AI | 0.7 | 0.15 | 0.03 | 0.05 | 0.001 | tr. | Comparative example |
| AJ | 0.48 | 0.15 | 0.03 | 0.05 | 0.001 | tr. | Comparative example |
| AK | 0.7 | 0.15 | 0.1 | 0.05 | 0.001 | tr. | Comparative example |
| AL | 0.7 | 0.15 | 0.03 | 0.1 | 0.001 | tr. | Comparative example |
| AM | 0.7 | 0.15 | 0.03 | 0.05 | tr. | tr. | Comparative example |

TABLE 3

| No | Type of steel | Slab reheating temperature (° C.) | Finishing temperature (° C.) | Average cooling rate between FT and (FT −100° C.) (° C./s) | Coiling temperature (° C.) | First average Heating rate (° C./s) | Intermediate temperature (° C.) | Second average heating rate (° C./s) | Note |
|---|---|---|---|---|---|---|---|---|---|
| 1 | A | 1280 | 900 | 25 | 550 | 15 | 650 | 0.5 | Inventive example |
| 2 | B | 1270 | 890 | 50 | 530 | 20 | 700 | 0.4 | Inventive example |
| 3 | C | 1250 | 880 | 75 | 510 | 25 | 750 | 0.3 | Inventive example |
| 4 | D | 1230 | 860 | 85 | 590 | 30 | 800 | 0.2 | Inventive example |
| 5 | E | 1210 | 870 | 95 | 570 | 35 | 750 | 0.1 | Inventive example |
| 6 | F | 1180 | 890 | 115 | 550 | 40 | 700 | 0.3 | Inventive example |
| 7 | G | 1170 | 910 | 135 | 530 | 35 | 650 | 0.5 | Inventive example |
| 8 | H | 1250 | 930 | 120 | 510 | 25 | 600 | 0.7 | Inventive example |
| 9 | I | 1250 | 920 | 110 | 470 | 15 | 550 | 0.9 | Inventive example |

TABLE 3-continued

| No | Type of steel | Slab reheating temperature (° C.) | Finishing temperature (° C.) | Average cooling rate between FT and (FT −100° C.) (° C./s) | Coiling temperature (° C.) | First average Heating rate (° C./s) | Intermediate temperature (° C.) | Second average heating rate (° C./s) | Note |
|---|---|---|---|---|---|---|---|---|---|
| 10 | J | 1280 | 900 | 90 | 450 | 10 | 650 | 1.5 | Inventive example |
| 11 | K | 1270 | 880 | 85 | 480 | 15 | 700 | 2.5 | Inventive example |
| 12 | L | 1250 | 890 | 75 | 500 | 20 | 750 | 5.5 | Inventive example |
| 13 | M | 1230 | 880 | 80 | 520 | 25 | 680 | 7.5 | Inventive example |
| 14 | N | 1210 | 860 | 75 | 540 | 30 | 660 | 6.5 | Inventive example |
| 15 | O | 1180 | 870 | 85 | 560 | 35 | 640 | 3.5 | Inventive example |
| 16 | P | 1170 | 890 | 95 | 580 | 40 | 620 | 1.5 | Inventive example |
| 17 | Q | 1280 | 910 | 115 | 600 | 45 | 800 | 0.5 | Inventive example |
| 18 | R | 1270 | 930 | 135 | 570 | 50 | 780 | 0.1 | Inventive example |
| 19 | S | 1250 | 920 | 120 | 590 | 45 | 760 | 0.3 | Inventive example |
| 20 | T | 1230 | 900 | 110 | 560 | 35 | 740 | 0.6 | Comparative Example |
| 21 | U | 1210 | 910 | 90 | 550 | 25 | 720 | 0.9 | Comparative Example |
| 22 | V | 1180 | 930 | 85 | 530 | 15 | 700 | 1.6 | Comparative Example |
| 23 | W | 1170 | 920 | 75 | 560 | 20 | 680 | 2.6 | Comparative Example |
| 24 | L | 1350 | 900 | 95 | 570 | 25 | 710 | 2.4 | Comparative Example |
| 25 | L | 1210 | 920 | 80 | 600 | 3 | 790 | 0.1 | Comparative Example |
| 26 | L | 1180 | 900 | 95 | 590 | 20 | 800 | 15 | Comparative Example |
| 27 | L | 1170 | 900 | 85 | 570 | 15 | 780 | 0.5 | Comparative Example |
| 28 | L | 1280 | 900 | 80 | 550 | 20 | 740 | 1.5 | Comparative Example |
| 29 | L | 1250 | 880 | 95 | 530 | 35 | 700 | 2.5 | Comparative Example |
| 30 | L | 1280 | 890 | 85 | 510 | 20 | 720 | 3.5 | Comparative Example |

TABLE 4

| No | Type of Steel | Slab reheating temperature (° C.) | Finishing temperature (° C.) | Average cooling rate Between FT and (FT −100° C.) (° C./s) | Coiling temperature (° C.) | First average heating Rate (° C./s) | Intermediate temperature (° C.) | Second average heating rate (° C./s) | Note |
|---|---|---|---|---|---|---|---|---|---|
| 31 | X | 1230 | 910 | 20 | 420 | 10 | 700 | 1.4 | Inventive example |
| 32 | Y | 1200 | 920 | 30 | 530 | 30 | 520 | 3.2 | Inventive example |
| 33 | Z | 1180 | 900 | 60 | 460 | 25 | 750 | 0.6 | Inventive example |
| 34 | AA | 1160 | 920 | 70 | 550 | 15 | 600 | 0.9 | Inventive example |
| 35 | AB | 1200 | 930 | 40 | 490 | 25 | 660 | 1.2 | Inventive example |
| 36 | AC | 1220 | 900 | 55 | 510 | 20 | 620 | 0.8 | Comparative Example |
| 37 | AD | 1280 | 900 | 30 | 570 | 15 | 560 | 1.8 | Comparative Example |
| 38 | AE | 1200 | 900 | 45 | 420 | 5 | 640 | 3.8 | Comparative Example |

TABLE 4-continued

| No | Type of Steel | Slab reheating temperature (° C.) | Finishing temperature (° C.) | Average cooling rate Between FT and (FT −100° C.) (° C./s) | Coiling temperature (° C.) | First average heating Rate (° C./s) | Intermediate temperature (° C.) | Second average heating rate (° C./s) | Note |
|---|---|---|---|---|---|---|---|---|---|
| 39 | AF | 1200 | 920 | 20 | 500 | 30 | 650 | 5 | Comparative Example |
| 40 | AG | 1200 | 920 | 20 | 500 | 30 | 650 | 5 | Comparative Example |
| 41 | AH | 1200 | 920 | 20 | 500 | 30 | 650 | 5 | Comparative Example |
| 42 | AI | 1200 | 920 | 20 | 500 | 30 | 650 | 5 | Comparative Example |
| 43 | AJ | 1200 | 920 | 20 | 500 | 30 | 650 | 5 | Comparative Example |
| 44 | AK | 1200 | 920 | 20 | 500 | 30 | 650 | 5 | Comparative Example |
| 45 | AL | 1200 | 920 | 20 | 500 | 30 | 650 | 5 | Comparative Example |
| 46 | AM | 1200 | 920 | 20 | 500 | 30 | 650 | 5 | Comparative Example |
| 47 | L | 1200 | 920 | 4 | 500 | 30 | 650 | 5 | Comparative Example |
| 48 | L | 1200 | 920 | 9 | 500 | 30 | 650 | 5 | Inventive example |
| 49 | L | 1200 | 920 | 50 | 500 | 30 | 650 | 5 | Inventive example |
| 50 | L | 1200 | 920 | 120 | 500 | 30 | 650 | 5 | Inventive example |
| 51 | L | 1200 | 920 | 180 | 500 | 30 | 650 | 5 | Inventive example |
| 52 | L | 1200 | 920 | 20 | 500 | 4 | 650 | 5 | Comparative Example |
| 53 | L | 1200 | 920 | 20 | 500 | 8 | 650 | 5 | Inventive example |
| 54 | L | 1200 | 920 | 20 | 500 | 12 | 650 | 5 | Inventive example |
| 55 | L | 1200 | 920 | 20 | 500 | 20 | 650 | 5 | Inventive example |
| 56 | L | 1200 | 920 | 20 | 500 | 45 | 650 | 5 | Inventive example |
| 57 | L | 1200 | 920 | 20 | 500 | 30 | 650 | 0.04 | Comparative Example |
| 58 | L | 1200 | 920 | 20 | 500 | 30 | 650 | 0.2 | Inventive example |
| 59 | L | 1200 | 920 | 20 | 500 | 30 | 650 | 2 | Inventive example |
| 60 | L | 1200 | 920 | 20 | 500 | 30 | 650 | 4.5 | Inventive example |
| 61 | L | 1200 | 920 | 20 | 500 | 30 | 650 | 8 | Inventive example |
| 62 | L | 1200 | 920 | 20 | 500 | 30 | 650 | 12 | Comparative Example |

TABLE 5

| No | Type of Steel | Annealing temperature (° C.) | Holding time (s) | Average cooling rate (° C./s) | cooling stopping temperature (° C.) | Alloying treatment | Skin pass (%) | Note |
|---|---|---|---|---|---|---|---|---|
| 1 | A | 825 | 25 | 5 | 515 | Yes | 0.3 | Inventive Example |
| 2 | B | 820 | 35 | 7 | 525 | Yes | 0.3 | Inventive Example |
| 3 | C | 820 | 45 | 9 | 510 | Yes | 0.3 | Inventive Example |
| 4 | D | 845 | 100 | 15 | 490 | Yes | 0.3 | Inventive Example |
| 5 | E | 825 | 200 | 25 | 495 | Yes | 0.3 | Inventive Example |
| 6 | F | 815 | 50 | 8 | 500 | Yes | 0.3 | Inventive Example |

TABLE 5-continued

| No | Type of Steel | Annealing temperature (° C.) | Holding time (s) | Average cooling rate (° C./s) | cooling stopping temperature (° C.) | Alloying treatment | Skin pass (%) | Note |
|---|---|---|---|---|---|---|---|---|
| 7 | G | 835 | 45 | 30 | 505 | Yes | 0.3 | Inventive Example |
| 8 | H | 820 | 40 | 20 | 515 | Yes | 0.3 | Inventive Example |
| 9 | I | 825 | 35 | 10 | 495 | Yes | 0.3 | Inventive Example |
| 10 | J | 835 | 80 | 5 | 500 | Yes | 0.3 | Inventive Example |
| 11 | K | 820 | 70 | 8 | 490 | Yes | 0.3 | Inventive Example |
| 12 | L | 830 | 50 | 10 | 480 | Yes | 0.3 | Inventive Example |
| 13 | M | 825 | 45 | 12 | 485 | Yes | 0.3 | Inventive Example |
| 14 | N | 840 | 130 | 16 | 490 | Yes | 0.3 | Inventive Example |
| 15 | O | 815 | 110 | 20 | 495 | Yes | 0.3 | Inventive Example |
| 16 | P | 835 | 90 | 15 | 500 | Yes | 0.3 | Inventive Example |
| 17 | Q | 845 | 70 | 10 | 505 | Yes | 0.3 | Inventive Example |
| 18 | R | 830 | 40 | 7 | 510 | No | 0.3 | Inventive Example |
| 19 | S | 820 | 30 | 10 | 515 | No | 0.3 | Inventive Example |
| 20 | T | 830 | 35 | 15 | 520 | Yes | 0.3 | Comparative Example |
| 21 | U | 825 | 45 | 20 | 495 | Yes | 0.3 | Comparative Example |
| 22 | V | 835 | 55 | 15 | 505 | Yes | 0.3 | Comparative Example |
| 23 | W | 830 | 65 | 20 | 515 | Yes | 0.3 | Comparative Example |
| 24 | L | 830 | 85 | 7 | 500 | Yes | 0.3 | Comparative Example |
| 25 | L | 830 | 65 | 20 | 485 | Yes | 0.3 | Comparative Example |
| 26 | L | 835 | 45 | 15 | 495 | Yes | 0.3 | Comparative Example |
| 27 | L | 950 | 55 | 12 | 505 | Yes | 0.3 | Comparative Example |
| 28 | L | 830 | 600 | 10 | 515 | Yes | 0.3 | Comparative Example |
| 29 | L | 825 | 45 | 0.3 | 495 | Yes | 0.3 | Comparative Example |
| 30 | L | 830 | 35 | 8 | 570 | Yes | 0.3 | Comparative Example |

TABLE 6

| No | Type of steel | Annealing temperature (° C.) | Holding time (s) | Average cooling rate (° C./s) | Cooling stopping temperature (° C.) | Alloying treatment | Skin pass (%) | Note |
|---|---|---|---|---|---|---|---|---|
| 31 | X | 850 | 50 | 15 | 500 | Yes | 0.3 | Inventive example |
| 32 | Y | 770 | 150 | 10 | 520 | Yes | 0.3 | Inventive example |
| 33 | Z | 860 | 90 | 20 | 495 | Yes | 0.3 | Inventive example |
| 34 | AA | 780 | 180 | 8 | 510 | Yes | 0.3 | Inventive Example |
| 35 | AB | 800 | 100 | 10 | 460 | Yes | 0.3 | Inventive Example |
| 36 | AC | 860 | 80 | 12 | 505 | Yes | 0.3 | Comparative Example |
| 37 | AD | 830 | 40 | 12 | 485 | Yes | 0.3 | Comparative Example |
| 38 | AE | 820 | 60 | 25 | 470 | Yes | 0.3 | Comparative Example |

TABLE 6-continued

| No | Type of steel | Annealing temperature (° C.) | Holding time (s) | Average cooling rate (° C./s) | Cooling stopping temperature (° C.) | Alloying treatment | Skin pass (%) | Note |
|---|---|---|---|---|---|---|---|---|
| 39 | AF | 820 | 100 | 15 | 500 | Yes | 0.5 | Comparative Example |
| 40 | AG | 820 | 100 | 15 | 500 | Yes | 0.5 | Comparative Example |
| 41 | AH | 820 | 100 | 15 | 500 | Yes | 0.5 | Comparative Example |
| 42 | AI | 820 | 100 | 15 | 500 | Yes | 0.5 | Comparative Example |
| 43 | AJ | 820 | 100 | 15 | 500 | Yes | 0.5 | Comparative Example |
| 44 | AK | 820 | 100 | 15 | 500 | Yes | 0.5 | Comparative Example |
| 45 | AL | 820 | 100 | 15 | 500 | Yes | 0.5 | Comparative Example |
| 46 | AM | 820 | 100 | 15 | 500 | Yes | 0.5 | Comparative Example |
| 47 | L | 820 | 100 | 15 | 500 | Yes | 0.5 | Comparative Example |
| 48 | L | 820 | 100 | 15 | 500 | Yes | 0.5 | Inventive Example |
| 49 | L | 820 | 100 | 15 | 500 | Yes | 0.5 | Inventive Example |
| 50 | L | 820 | 100 | 15 | 500 | Yes | 0.5 | Inventive Example |
| 51 | L | 820 | 100 | 15 | 500 | Yes | 0.5 | Inventive Example |
| 52 | L | 820 | 100 | 15 | 500 | Yes | 0.5 | Comparative Example |
| 53 | L | 820 | 100 | 15 | 500 | Yes | 0.5 | Inventive Example |
| 54 | L | 820 | 100 | 15 | 500 | Yes | 0.5 | Inventive Example |
| 55 | L | 820 | 100 | 15 | 500 | Yes | 0.5 | Inventive Example |
| 56 | L | 820 | 100 | 15 | 500 | Yes | 0.5 | Inventive Example |
| 57 | L | 820 | 100 | 15 | 500 | Yes | 0.5 | Comparative Example |
| 58 | L | 820 | 100 | 15 | 500 | Yes | 0.5 | Inventive Example |
| 59 | L | 820 | 100 | 15 | 500 | Yes | 0.5 | Inventive Example |
| 60 | L | 820 | 100 | 15 | 500 | Yes | 0.5 | Inventive Example |
| 61 | L | 820 | 100 | 15 | 500 | Yes | 0.5 | Inventive Example |
| 62 | L | 820 | 100 | 15 | 500 | Yes | 0.5 | Comparative Example |

TABLE 7

| | | Microstructure of steel sheet | | | | | |
|---|---|---|---|---|---|---|---|
| | | Ferrite | | Bainite and/ or martensite | | Remaining microstructure* | |
| No | Type of steel | Average size (μm) | Volume fraction (%) | Average Size (μm) | Volume fraction (%) | Volume fraction (%) | Note |
| 1 | A | 2.8 | 42 | 1.9 | 57 | 1(γ') | Inventive Example |
| 2 | B | 2.9 | 43 | 2.2 | 55 | 2(γ'') | Inventive Example |
| 3 | C | 1.8 | 43 | 2.6 | 53 | 4(γ') | Inventive Example |
| 4 | D | 1.9 | 42 | 3.5 | 58 | 0 | Inventive Example |
| 5 | E | 1.7 | 43 | 2.7 | 55 | 2(γ') | Inventive Example |
| 6 | F | 2.9 | 51 | 2.6 | 48 | 1(γ') | Inventive Example |

TABLE 7-continued

| | | Microstructure of steel sheet | | | | | |
|---|---|---|---|---|---|---|---|
| | | Ferrite | | Bainite and/ or martensite | | Remaining microstructure* | |
| No | Type of steel | Average size (μm) | Volume fraction (%) | Average Size (μm) | Volume fraction (%) | Volume fraction (%) | Note |
| 7 | G | 1.6 | 42 | 2.9 | 58 | 0 | Inventive Example |
| 8 | H | 2.2 | 48 | 2.1 | 52 | 0 | Inventive Example |
| 9 | I | 2.7 | 49 | 2.0 | 50 | 1(γ') | Inventive Example |
| 10 | J | 2.9 | 42 | 2.7 | 56 | 2(γ') | Inventive Example |
| 11 | K | 2.7 | 49 | 3.0 | 49 | 2(γ') | Inventive Example |
| 12 | L | 2.8 | 43 | 2.5 | 55 | 2(γ') | Inventive Example |
| 13 | M | 2.9 | 43 | 2.3 | 56 | 1(γ') | Inventive Example |
| 14 | N | 2.7 | 42 | 3.1 | 54 | 4(γ') | Inventive Example |
| 15 | O | 3.5 | 48 | 2.8 | 52 | 0 | Inventive Example |
| 16 | P | 2.9 | 42 | 2.5 | 57 | 1(γ') | Inventive Example |
| 17 | Q | 2.4 | 42 | 3.0 | 56 | 2(γ') | Inventive Example |
| 18 | R | 1.8 | 43 | 2.4 | 56 | 1(γ') | Inventive Example |
| 19 | S | 1.9 | 43 | 2.2 | 57 | 0 | Inventive Example |
| 20 | T | 1.7 | 44 | 2.4 | 56 | 0 | Comparative Example |
| 21 | U | 2.9 | 41 | 2.3 | 58 | 1(γ') | Comparative Example |
| 22 | V | 2.6 | 43 | 5.5 | 57 | 0 | Comparative Example |
| 23 | W | 2.2 | 37 | 5.6 | 60 | 3(γ') | Comparative Example |
| 24 | L | 7.8 | 43 | 10.6 | 55 | 2(γ') | Comparative Example |
| 25 | L | 5.9 | 43 | 6.9 | 56 | 1(γ') | Comparative Example |
| 26 | L | 1.6 | 74 | 3.9 | 26 | 0 | Comparative Example |
| 27 | L | 7.5 | 28 | 10.8 | 72 | 0 | Comparative Example |
| 28 | L | 6.8 | 43 | 7.2 | 53 | 4(γ') | Comparative Example |
| 29 | L | 2.9 | 72 | 3.5 | 18 | 10(P + γ') | Comparative Example |
| 30 | L | 2.7 | 45 | 4.2 | 43 | 12(P + γ') | Comparative Example |

*Remaining microstructure
γ': retained austenite
P: pearlite

TABLE 8

| | | Microstructure of steel sheet | | | | | |
|---|---|---|---|---|---|---|---|
| | | Ferrite | | Bainite and/or martensite | | Remaining microstructure* | |
| No | Type of steel | Average size (μm) | Volume fraction (%) | Average size (μm) | Volume fraction (%) | Volume fraction (%) | Note |
| 31 | X | 4.2 | 32 | 3.8 | 66 | 2(γ') | Inventive Example |
| 32 | Y | 3.5 | 48 | 3.1 | 51 | 1(γ') | Inventive Example |

TABLE 8-continued

| | | Microstructure of steel sheet | | | | | |
|---|---|---|---|---|---|---|---|
| | | Ferrite | | Bainite and/or martensite | | Remaining microstructure* | |
| No | Type of steel | Average size (μm) | Volume fraction (%) | Average size (μm) | Volume fraction (%) | Volume fraction (%) | Note |
| 33 | Z | 2.9 | 40 | 2.6 | 60 | 0 | Inventive Example |
| 34 | AA | 1.8 | 53 | 1.9 | 46 | 1(γ') | Inventive Example |
| 35 | AB | 2.2 | 45 | 2.6 | 53 | 2(γ') | Inventive Example |
| 36 | AC | 4.7 | 42 | 5.3 | 58 | 0 | Comparative Example |
| 37 | AD | 4.3 | 44 | 4.6 | 54 | 2(γ') | Comparative Example |
| 38 | AE | 3.2 | 35 | 3.8 | 62 | 3(γ') | Comparative Example |
| 39 | AF | 4.3 | 64 | 3.4 | 34 | 2(γ') | Comparative Example |
| 40 | AG | 3.2 | 59 | 2.9 | 38 | 3(γ') | Comparative Example |
| 41 | AH | 3.0 | 45 | 2.4 | 51 | 4(γ') | Comparative Example |
| 42 | AI | 3.3 | 48 | 2.8 | 47 | 5(γ') | Comparative Example |
| 43 | AJ | 3.1 | 44 | 2.4 | 54 | 2(γ') | Comparative Example |
| 44 | AK | 2.8 | 56 | 2.2 | 41 | 3(γ') | Comparative Example |
| 45 | AL | 2.4 | 52 | 1.9 | 47 | 1(γ') | Comparative Example |
| 46 | AM | 3.6 | 72 | 3.0 | 27 | 1(γ') | Comparative Example |
| 47 | L | 5.2 | 47 | 4.8 | 51 | 2(γ') | Comparative Example |
| 48 | L | 3.7 | 45 | 2.4 | 55 | 0 | Inventive Example |
| 49 | L | 3.2 | 43 | 2.4 | 56 | 1(γ') | Inventive Example |
| 50 | L | 2.8 | 42 | 2.3 | 56 | 2(γ') | Inventive Example |
| 51 | L | 2.7 | 42 | 2.3 | 57 | 1(γ') | Inventive Example |
| 52 | L | 6.1 | 40 | 5.1 | 58 | 2(γ') | Comparative Example |
| 53 | L | 4.7 | 41 | 4.1 | 57 | 2(γ') | Inventive Example |
| 54 | L | 3.4 | 42 | 3.2 | 55 | 3(γ') | Inventive Example |
| 55 | L | 3.0 | 43 | 2.9 | 55 | 2(γ') | Inventive Example |
| 56 | L | 2.8 | 44 | 2.6 | 54 | 2(γ') | Inventive Example |
| 57 | L | 6.3 | 40 | 5.1 | 60 | 0 | Comparative Example |
| 58 | L | 3.4 | 42 | 3.4 | 57 | 1(γ') | Inventive Example |
| 59 | L | 3.2 | 43 | 3.0 | 56 | 1(γ') | Inventive Example |
| 60 | L | 2.9 | 44 | 2.4 | 55 | 1(γ') | Inventive Example |
| 61 | L | 2.7 | 61 | 2.2 | 39 | 0 | Inventive Example |
| 62 | L | 2.6 | 73 | 2.1 | 26 | 1(γ') | Comparative Example |

*Remaining microstructure

γ': retained austenite

P: pearlite

TABLE 9

| No | Type of Steel | Material properties YP (MPa) | TS (MPa) | El (%) | λ (%) | TS × El (MPa · %) | TS × λ (MPa · %) | Critical bending radius (mm) | Resistance spot weldability (type of cross tension breakage) | Note |
|---|---|---|---|---|---|---|---|---|---|---|
| 1 | A | 701 | 1001 | 15.0 | 43 | 15019 | 43054 | 0.5 | Base metal breakage | Inventive Example |
| 2 | B | 720 | 1028 | 14.6 | 42 | 15015 | 43193 | 0.5 | Base metal breakage | Inventive Example |
| 3 | C | 718 | 1026 | 14.7 | 42 | 15077 | 43078 | 1.0 | Base metal breakage | Inventive Example |
| 4 | D | 675 | 1008 | 14.9 | 43 | 15021 | 43349 | 1.0 | Base metal breakage | Inventive Example |
| 5 | E | 700 | 1030 | 14.6 | 42 | 15037 | 43258 | 0.5 | Base metal breakage | Inventive Example |
| 6 | F | 752 | 1074 | 14.1 | 43 | 15140 | 46170 | 1.0 | Base metal breakage | Inventive Example |
| 7 | G | 703 | 1004 | 15.0 | 43 | 15063 | 43181 | 1.0 | Base metal breakage | Inventive Example |
| 8 | H | 729 | 1041 | 14.5 | 42 | 15101 | 43740 | 0.5 | Base metal breakage | Inventive Example |
| 9 | I | 705 | 1037 | 14.8 | 42 | 15350 | 43560 | 0.5 | Base metal breakage | Inventive Example |
| 10 | J | 711 | 1015 | 14.9 | 43 | 15129 | 43660 | 1.0 | Base metal breakage | Inventive Example |
| 11 | K | 695 | 1038 | 14.5 | 42 | 15045 | 43578 | 1.0 | Base metal breakage | Inventive Example |
| 12 | L | 685 | 1022 | 14.7 | 43 | 15018 | 43931 | 0.5 | Base metal breakage | Inventive Example |
| 13 | M | 680 | 1015 | 14.8 | 43 | 15023 | 43647 | 0.5 | Base metal breakage | Inventive Example |
| 14 | N | 682 | 1004 | 15.1 | 43 | 15155 | 43156 | 1.0 | Base metal breakage | Inventive Example |
| 15 | O | 706 | 1038 | 14.5 | 42 | 15057 | 43612 | 1.0 | Base metal breakage | Inventive Example |
| 16 | P | 707 | 1010 | 14.9 | 43 | 15046 | 43422 | 1.0 | Base metal breakage | Inventive Example |
| 17 | Q | 696 | 994 | 15.1 | 44 | 15003 | 43718 | 1.0 | Base metal breakage | Inventive Example |
| 18 | R | 718 | 1025 | 14.8 | 42 | 15170 | 43050 | 0.5 | Base metal breakage | Inventive Example |
| 19 | S | 722 | 1031 | 14.6 | 42 | 15056 | 43312 | 0.5 | Base metal breakage | Inventive Example |
| 20 | T | 784 | 1120 | 11.2 | 36 | 12544 | 40180 | 0.5 | Broken within nugget | Comparative Example |
| 21 | U | 682 | 1003 | 10.1 | 39 | 10133 | 39129 | 2.0 | Base metal breakage | Comparative Example |
| 22 | V | 722 | 1032 | 14.6 | 25 | 15067 | 25800 | 3.0 | Base metal breakage | Comparative Example |
| 23 | W | 759 | 1084 | 11.8 | 37 | 12795 | 40180 | 2.5 | Broken within nugget | Comparative Example |
| 24 | L | 715 | 1022 | 14.7 | 28 | 15018 | 28606 | 3.5 | Base metal breakage | Comparative Example |
| 25 | L | 686 | 1024 | 14.7 | 27 | 15053 | 27648 | 3.0 | Base metal breakage | Comparative Example |
| 26 | L | 556 | 817 | 19.5 | 34 | 15932 | 27778 | 0.5 | Base metal breakage | Comparative Example |
| 27 | L | 819 | 1170 | 10.1 | 24 | 11817 | 28080 | 3.5 | Base metal breakage | Comparative Example |
| 28 | L | 711 | 1015 | 14.8 | 23 | 15022 | 23345 | 2.5 | Base metal breakage | Comparative Example |
| 29 | L | 540 | 771 | 19.2 | 45 | 14803 | 34695 | 0.5 | Base metal breakage | Comparative Example |
| 30 | L | 715 | 905 | 17.8 | 22 | 16109 | 19910 | 0.5 | Base metal breakage | Comparative Example |

TABLE 10

| No | Type of Steel | Material properties: YP (MPa) | TS (MPa) | El (%) | λ (%) | TS × El (MPa · %) | TS × λ (MPa · %) | Critical bending radius (mm) | Resistance spot weldability (type of cross tension breakage) | Note |
|---|---|---|---|---|---|---|---|---|---|---|
| 31 | X | 746 | 1051 | 16.2 | 42 | 17026 | 44142 | 2.0 | Base metal breakage | Inventive Example |
| 32 | Y | 704 | 1009 | 16.7 | 43 | 16850 | 43387 | 1.5 | Base metal breakage | Inventive Example |
| 33 | Z | 711 | 1030 | 15.0 | 42 | 15450 | 43260 | 1.0 | Base metal breakage | Inventive Example |
| 34 | AA | 738 | 1025 | 14.7 | 42 | 15068 | 43050 | 0.5 | Base metal breakage | Inventive Example |
| 35 | AB | 674 | 1048 | 16.2 | 44 | 16978 | 46112 | 1.0 | Base metal breakage | Inventive Example |
| 36 | AC | 625 | 991 | 16.1 | 42 | 15955 | 41622 | 2.5 | Base metal breakage | Comparative Example |
| 37 | AD | 605 | 1014 | 16.5 | 30 | 16731 | 30420 | 2.0 | Broken within nugget | Comparative Example |
| 38 | AE | 764 | 1082 | 14.1 | 41 | 15256 | 44362 | 2.0 | Broken within nugget | Comparative Example |
| 39 | AF | 540 | 820 | 17.8 | 50 | 14596 | 41000 | 0.5 | Base metal breakage | Comparative Example |
| 40 | AG | 634 | 955 | 15.1 | 47 | 14421 | 44885 | 0.5 | Base metal breakage | Comparative Example |
| 41 | AH | 710 | 1034 | 16.2 | 42 | 16751 | 43428 | 0.5 | Broken within nugget | Comparative Example |
| 42 | AI | 628 | 989 | 16.9 | 40 | 16714 | 39560 | 1.0 | Broken within nugget | Comparative Example |
| 43 | AJ | 614 | 972 | 14.6 | 35 | 14191 | 34020 | 2.0 | Base metal breakage | Comparative Example |
| 44 | AK | 913 | 1072 | 11.2 | 41 | 12006 | 43952 | 1.5 | Base metal breakage | Comparative Example |
| 45 | AL | 845 | 1062 | 11.9 | 40 | 12638 | 42480 | 2.5 | Base metal breakage | Comparative Example |
| 46 | AM | 608 | 946 | 16.1 | 37 | 15231 | 35002 | 1.0 | Base metal breakage | Comparative Example |
| 47 | L | 621 | 982 | 14.9 | 38 | 14632 | 37316 | 2.5 | Base metal breakage | Comparative Example |
| 48 | L | 672 | 1001 | 15.0 | 43 | 15015 | 43043 | 1.5 | Base metal breakage | Inventive Example |
| 49 | L | 701 | 1031 | 15.3 | 43 | 15774 | 44333 | 1.0 | Base metal breakage | Inventive Example |
| 50 | L | 715 | 1040 | 16.2 | 43 | 16848 | 44720 | 0.5 | Base metal breakage | Inventive Example |
| 51 | L | 725 | 1042 | 16.4 | 44 | 17089 | 45848 | 0.5 | Base metal breakage | Inventive Example |
| 52 | L | 652 | 1031 | 14.1 | 40 | 14537 | 41240 | 2.0 | Base metal breakage | Comparative Example |
| 53 | L | 658 | 1029 | 14.7 | 42 | 15141 | 43260 | 1.5 | Base metal breakage | Inventive Example |
| 54 | L | 677 | 1025 | 15.2 | 43 | 15580 | 44075 | 1.0 | Base metal breakage | Inventive Example |
| 55 | L | 659 | 1022 | 15.4 | 44 | 15739 | 44968 | 1.0 | Base metal breakage | Inventive Example |
| 56 | L | 650 | 1009 | 15.8 | 45 | 15942 | 45405 | 0.5 | Base metal breakage | Inventive Example |
| 57 | L | 703 | 1037 | 13.3 | 34 | 13792 | 35258 | 2.5 | Base metal breakage | Comparative Example |
| 58 | L | 670 | 1024 | 14.7 | 43 | 15053 | 44032 | 1.0 | Base metal breakage | Inventive Example |
| 59 | L | 655 | 1030 | 15.2 | 44 | 15656 | 45320 | 0.5 | Base metal breakage | Inventive Example |
| 60 | L | 652 | 1027 | 15.2 | 43 | 15610 | 44161 | 1.0 | Base metal breakage | Inventive Example |
| 61 | L | 645 | 983 | 15.8 | 44 | 15531 | 43252 | 1.5 | Base metal breakage | Inventive Example |
| 62 | L | 621 | 942 | 16.7 | 37 | 15731 | 34854 | 2.5 | Base metal breakage | Comparative Example |

Table 3 shows that inventive examples had TS×El≧15000 MPa·%, TS×λ≧43000 MPa·%, and a critical bending radius ≦1.5 t (t: sheet thickness) in a 90° V block bend, and excellent resistance spot weldability at the same time. Thus, high tensile-strength galvanized steel sheets having excellent formability were provided.

By contrast, Nos. 20 to 23 and Nos. 36 to 46, which are comparative examples, could not achieve at least one of formability and weldability.

Nos. 24, 25, 28, 47, and 52, in which the slab reheating temperature, the cooling rate immediately after hot-rolling, the first heating rate, or the holding time was outside of our range, had a large ferrite grain size and therefore had poor stretch flangeability.

Nos. 26, 29, and 62, which had the second heating rate or the cooling rate to the cooling stopping temperature outside of our range, had a large ferrite fraction and therefore had a TS of less than 980 MPa. No. 57 had a large ferrite grain size and therefore had poor formability.

No. 27, whose annealing temperature was outside of our range, had a large crystal grain size and a small ferrite fraction; therefore, No. 27 had a low El, a low hole expansion ratio λ, and therefore poor formability.

No. 30, whose cooling stopping temperature was outside of our range, had a TS of less than 980 MPa, a low λ, and poor formability.

Example 2

Galvanized steel sheets were manufactured from steel having compositions shown in Table 11 in the same way as Example 1. The manufacturing conditions were as follows:

Slab reheating temperature SRT: 1200° C.

Finishing temperature FT: 910° C.

Average cooling rate between finishing temperature to (finishing temperature—100° C.): 40° C./s Coiling temperature CT: 500° C.

Average first heating rate: 20° C./s

Intermediate temperature: 700° C.

Average second heating rate: 5° C./s

Annealing temperature: 800° C.

Holding time: 60 seconds

Average cooling rate from annealing temperature: 10° C./s cooling stopping temperature: 500° C.

Alloying treatment conditions: galvanizing bath temperature 460° C., alloying treatment conditions 520° C. 20 seconds Skin pass %: 0.3%

Tables 12 and 13 show the characteristics of the resultant galvannealed steel sheets. Methods for determining the measured values were the same as in Example 1. Regarding resistance spot weldability, No. 65 was broken within a nugget, but the other exhibited base metal breakage.

Regarding galvanizing ability, a plated steel sheet having neither an ungalvanized surface nor an uneven appearance due to delayed alloying was rated good; a plated steel sheet having an ungalvanized surface or an uneven appearance was rated defective.

TABLE 11-1

| Type of steel | Composition (part 1) (% by mass) C | Si | Mn | P | S | Al | N | Note |
|---|---|---|---|---|---|---|---|---|
| BA | 0.095 | 0.30 | 2.25 | 0.007 | 0.0009 | 0.045 | 0.0035 | Present invention |
| BB | 0.095 | 0.38 | 2.25 | 0.007 | 0.0009 | 0.045 | 0.0035 | Comparative Example |
| BC | 0.095 | 0.05 | 3.60 | 0.007 | 0.0009 | 0.045 | 0.0035 | Comparative Example |
| BD | 0.095 | 0.05 | 2.25 | 0.007 | 0.0009 | 0.045 | 0.0035 | Present invention |
| BE | 0.095 | 0.05 | 2.25 | 0.007 | 0.0009 | 0.045 | 0.0035 | Comparative Example |

TABLE 11-2

| Type of steel | Composition (part 2) (% by mass) Cr | Mo | Ti | Nb | B | Ca | Note |
|---|---|---|---|---|---|---|---|
| BA | 0.65 | 0.08 | 0.055 | 0.052 | 0.0011 | tr. | Inventive Example |
| BB | 0.65 | 0.08 | 0.055 | 0.052 | 0.0011 | tr. | Comparative Example |
| BC | 0.65 | 0.08 | 0.055 | 0.052 | 0.0011 | tr. | Comparative Example |
| BD | 1.4 | 0.08 | 0.055 | 0.052 | 0.0011 | tr. | Inventive Example |
| BE | 2.2 | 0.08 | 0.055 | 0.052 | 0.0011 | tr. | Comparative Example |

TABLE 12

| No | Type of steel | Microstructure of steel sheet: Ferrite Average size (μm) | Ferrite Volume fraction (%) | Bainite and/or martensite Average size (μm) | Bainite and/or martensite Volume fraction (%) | Remaining microstructure* Volume fraction (%) | Note |
|---|---|---|---|---|---|---|---|
| 63 | BA | 2.5 | 51 | 2.1 | 48 | 1(γ') | Inventive Example |
| 64 | BB | 2.6 | 50 | 2.1 | 48 | 2(γ') | Comparative Example |
| 65 | BC | 2.6 | 41 | 2.1 | 57 | 2(γ') | Comparative Example |
| 66 | BD | 2.5 | 42 | 2.0 | 57 | 1(γ') | Inventive Example |
| 67 | BE | 2.5 | 41 | 2.0 | 58 | 1(γ') | Comparative Example |

*Remaining microstructure
γ': retained austenite
P: pearlite

TABLE 13

| No | Type of Steel | Material properties: YP (MPa) | TS (MPa) | El (%) | λ (%) | TS × El (MPa · %) | TS × λ (MPa · %) | Critical bending radius (mm) | Galvanizing ability | Note |
|---|---|---|---|---|---|---|---|---|---|---|
| 63 | BA | 772 | 1036 | 15.2 | 45 | 15747 | 46620 | 0.5 | Good | Inventive Example |
| 64 | BB | 768 | 1042 | 14.8 | 44 | 15422 | 45848 | 0.5 | Poor | Comparative Example |
| 65 | BC | 781 | 1092 | 13.1 | 38 | 14305 | 41496 | 2.5 | Poor | Comparative Example |
| 66 | BD | 831 | 1135 | 13.4 | 41 | 15209 | 46535 | 0.5 | Good | Inventive Example |
| 67 | BE | 868 | 1167 | 12.1 | 39 | 14121 | 45513 | 0.5 | Poor | Comparative Example |

All the inventive examples had excellent formability and galvanizing ability. However, comparative examples in which the amount of an alloying element was outside of our range had poor galvanizing ability.

Industrial Applicability

A high tensile-strength galvanized steel sheet having excellent formability and weldability can be manufactured. A high tensile-strength galvanized steel sheet has strength and formability required for an automobile part, and is suitable as an automobile part that is pressed in a difficult shape.

Furthermore, since a high tensile-strength galvanized steel sheet has excellent formability and weldability, it can be suitably used in applications that require high dimensional accuracy and formability, such as construction and consumer electronics.

The invention claimed is:

1. A high tensile-strength galvanized steel sheet, comprising:

as a percentage of mass,

C: at least 0.05% but less than 0.12%, Si: at least 0.01% but less than 0.35%,

Mn: 2.0% to 3.5%, P: 0.001% to 0.020%,

S: 0.0001% to 0.0030%, Al: 0.005% to 0.1%,

N: 0.0001% to 0.0060%, Cr: more than 0.5% but not more than 2.0%,

Mo: 0.01% to 0.50%, Ti: 0.010% to 0.080%,

Nb: 0.010% to 0.080%, and B: 0.0001% to 0.0030%, the remainder being Fe and unavoidable impurities, having a microstructure that contains 20% to 70% by volume ferrite having an average grain size of 3.5 μm or less, a tensile strength of at least 980 MPa, tensile strength (TS) x elongation (El) of at least 15000 MPa·%, tensile strength (TS)×hole expansion ratio (λ) of at least 43000 MPa·% and a critical bending radius of not more than 1.5×sheet thickness (t) of the steel sheet, and a galvanized zinc layer at a coating weight in a range of 20 to 150 g/m$^2$ per side on a surface thereof.

2. A high tensile-strength galvanized steel sheet, comprising:

as a percentage of mass,

C: at least 0.05% but less than 0.12%, Si: at least 0.01% but less than 0.35%

Mn: 2.0% to 3.5%, P: 0.001% to 0.020%,

S: 0.0001% to 0.0030%, Al: 0.005% to 0.1%,

N: 0.0001% to 0.0060%, Cr: more than 0.5% but not more than 2.0%,

Mo: 0.01% to 0.50%, Ti: 0.010% to 0.080%,
Nb: 0.010% to 0.080%, and B: 0.0001% to 0.0030%,
the remainder being Fe and unavoidable impurities, and containing,
as a percentage by volume,
20% to 70% ferrite having an average grain size of 3.5 μm or less; and
30% to 80% bainite and/or martensite each having an average grain size of 3.5 μm or less,
wherein the amount of remaining microstructure is 5% or less (including zero),
and the high tensile-strength galvanized steel sheet has a tensile strength of at least 980 MPa, tensile strength (TS)×elongation (El) of at least 15000 MPa·%, tensile strength (TS)×hole expansion ratio (λ) of at least 43000 MPa·% and a critical bending radius of not more than 1.5×sheet thickness (t) of the steel sheet, and has a galvanized zinc layer at a coating weight in a range of 20 to 150 g/m$^2$ per side on a surface thereof.

3. A high tensile-strength galvanized steel sheet, comprising:
as a percentage of mass,
C: at least 0.05% but less than 0.10%, Si: at least 0.01% but less than 0.35%,
Mn: 2.0% to 3.5%, P: 0.001% to 0.020%,
S: 0.0001% to 0.0020%, Al: 0.005% to 0.1%,
N: 0.0001% to 0.0050%, Cr: more than 0.5% but not more than 2.0%,
Mo: 0.01% to 0.50%, Ti: 0.010% to 0.080%,
Nb: 0.010% to 0.080%, and B: 0.0001% to 0.0030%,
the remainder being Fe and unavoidable impurities,
having a microstructure that contains 20% to 60% by volume ferrite having an average grain size of 3.5 μm or less,
a tensile strength of at least 980 MPa, tensile strength (TS)×elongation (El) of at least 15000 MPa·%, tensile strength (TS)×hole expansion ratio (X) of at least 43000 MPa·% and a critical bending radius of not more than 1.5×sheet thickness (t) of the steel sheet, and a galvanized zinc layer at a coating weight in a range of 20 to 150 g/m$^2$ per side on a surface thereof.

4. A process for manufacturing a high tensile-strength galvanized steel sheet comprising:
subjecting a steel slab to a hot-rolling process, coiling, cold-rolling, and galvanizing to manufacture a galvanized steel sheet,
the steel slab containing,
as a percentage of mass,
C: at least 0.05% but less than 0.12%, Si: at least 0.01% but less than 0.35%,
Mn: 2.0% to 3.5%, P: 0.001% to 0.020%,
S: 0.0001% to 0.0030%, Al: 0.005% to 0.1%,
N: 0.0001% to 0.0060%, Cr: more than 0.5% but not more than 2.0%,
Mo: 0.01% to 0.50%, Ti: 0.010% to 0.080%,
Nb: 0.010% to 0.080%, and B: 0.0001% to 0.0030%,
the remainder being Fe and unavoidable impurities,
wherein, in the hot-rolling process, the slab is hot-rolled at a reheating temperature in a range of 1150° C. to 1300° C. and a finishing temperature in a range of 850° C. to 950° C., is then cooled from the finishing temperature to (finishing temperature - 100° C.) at an average cooling rate in a range of 5° C. to 200° C./s, and is coiled at a temperature in a range of 400° C. to 650° C., and
after cold rolling, the hot-rolled steel sheet is heated from 200° C. to an intermediate temperature at a first average heating rate in a range of 5° C. to 50° C./s, the intermediate temperature being in a range of 500° C. to 800° C., heated from the intermediate temperature to an annealing temperature at a second average heating rate in a range of 0.1° C. to 10° C./s, the annealing temperature being in a range of 750° C. to 900° C., held in the annealing temperature range for 10 to 500 seconds, cooled to a temperature in a range of 450° C. to 550° C. at an average cooling rate in a range of 1° C. to 30° C./s, and then subjected to hot-dip galvanizing and, optionally, alloying and wherein galvanized steel sheet is characterized by having a microstructure that contains 20% to 70% by volume ferrite with an average grain size of 3.5 μm or less, a tensile strength of at least 980 MPa, tensile strength (TS)×elongation (El) of at least 15000 MPa·%, tensile strength (TS)×hole expansion ratio (λ) of at least 43000 MPa·% and a critical bending radius of not more than 1.5×sheet thickness (t) of the steel sheet, and a galvanized zinc layer at a coating weight in a range of 20 to 150 g/m$^2$ per side on a surface thereof.

5. A process for manufacturing a high tensile-strength galvanized steel sheet comprising:
subjecting a steel slab to a hot-rolling process, coiling, pickling, cold-rolling, and galvanizing to manufacture a galvanized steel sheet,
the steel slab containing,
as a percentage of mass,
C: at least 0.05% but less than 0.10%, Si: at least 0.01% but less than 0.35%,
Mn: 2.0% to 3.5%, P: 0.001% to 0.020%,
S: 0.0001% to 0.0020%, Al: 0.005% to 0.1%,
N: 0.0001% to 0.0050%, Cr: more than 0.5% but not more than 2.0%,
Mo: 0.01% to 0.50%, Ti: 0.010% to 0.080%,
Nb: 0.010% to 0.080%, and B: 0.0001% to 0.0030%,
the remainder being Fe and unavoidable impurities,
wherein, in the hot-rolling process, the slab is hot-rolled at a reheating temperature in a range of 1150° C. to 1300° C. and a finishing temperature in a range of 850° C. to 950° C., then cooled from the finishing temperature to (finishing temperature - 100° C.) at an average cooling rate in a range of 5° C. to 200° C./s, and coiled at a temperature in a range of 400° C. to 600° C., and
after pickling, a hot-rolled steel sheet is cold-rolled, heated from 200° C. to an intermediate temperature at a first average heating rate in a range of 10° C. to 50° C./s, the intermediate temperature being in the range of 500° C. to 800° C., heated from the intermediate temperature to an annealing temperature at a second average heating rate in a range of 0.1° C. to 10° C./s, the annealing temperature being in the range of 750° C. to 900° C., held in the annealing temperature range for 10 to 500 seconds, cooled to a temperature in a range of 450° C. to 550° C. at an average cooling rate in a range of 1° C. to 30° C./s, and then subjected to hot-dip galvanizing and, optionally, alloying and wherein galvanized steel sheet is characterized by having a microstructure that contains 20% to 70% by volume ferrite with an average grain size of 3.5 μm or less, a tensile strength of at least 980 MPa, tensile strength (TS)×elongation (El) of at least 15000 MPa·%, tensile strength (TS)×hole expansion ratio (λ) of at least 43000 MPa·% and a critical bending radius of not more than 1.5×sheet thickness (t) of the steel sheet, and a galvanized zinc layer at a coating weight in a range of 20 to 150 g/m$^2$ per side on a surface thereof.

6. The high tensile-strength galvanized steel sheet, according to claim 1, wherein:

the C content is 0.05% or more but less than 0.10%, the S content is 0.0001% to 0.0020%, and the N content is 0.0001% to 0.0050%.

7. The high tensile-strength galvanized steel sheet, according to claim 1, wherein a microstructure contains 20% to 60% by volume ferrite.

* * * * *

UNITED STATES PATENT AND TRADEMARK OFFICE

CERTIFICATE OF CORRECTION

PATENT NO. : 8,389,128 B2
APPLICATION NO. : 12/595555
DATED : March 5, 2013
INVENTOR(S) : Takagi et al.

It is certified that error appears in the above-identified patent and that said Letters Patent is hereby corrected as shown below:

In the Specification

In Column 15

At Table 2 at the subheading "Mn", line 2, please change "0.42" to -- 2.42 --.

Signed and Sealed this
Twenty-fourth Day of September, 2013

Teresa Stanek Rea
*Deputy Director of the United States Patent and Trademark Office*